US012403371B2

(12) United States Patent
Luminati

(10) Patent No.: US 12,403,371 B2
(45) Date of Patent: Sep. 2, 2025

(54) EXERCISE TRAINING DEVICE

(71) Applicant: Dominik Luminati, Milwaukee, WI (US)

(72) Inventor: Dominik Luminati, Milwaukee, WI (US)

( * ) Notice: Subject to any disclaimer, the term of this patent is extended or adjusted under 35 U.S.C. 154(b) by 0 days.

(21) Appl. No.: 17/979,636

(22) Filed: Nov. 2, 2022

(65) Prior Publication Data

US 2024/0139601 A1 May 2, 2024

(51) Int. Cl.
*A63B 69/22* (2006.01)

(52) U.S. Cl.
CPC ..... *A63B 69/22* (2022.08)

(58) Field of Classification Search
CPC ..... A63B 69/22
See application file for complete search history.

(56) References Cited

U.S. PATENT DOCUMENTS

| | | | | |
|---|---|---|---|---|
| 5,342,267 | A * | 8/1994 | Adams | A63B 69/22 482/97 |
| 9,744,420 | B1 * | 8/2017 | Bergamini | A63B 69/22 |
| 9,839,827 | B1 * | 12/2017 | Roberts | A63B 23/12 |
| 10,252,135 | B1 * | 4/2019 | Roberts | A63B 69/244 |
| 10,639,535 | B2 * | 5/2020 | Hoover | A63B 69/22 |
| 11,938,372 | B1 * | 3/2024 | Roberts | A63B 23/12 |
| 2004/0176222 | A1 * | 9/2004 | Mitchell | A63B 69/22 482/83 |
| 2006/0025284 | A1 * | 2/2006 | Livingstone | A63B 69/22 482/83 |
| 2007/0167297 | A1 * | 7/2007 | Stevenson | A63B 71/023 482/90 |
| 2012/0129660 | A1 * | 5/2012 | Eem | A63B 69/22 482/83 |
| 2017/0348577 | A1 * | 12/2017 | Chen | A63B 69/20 |
| 2018/0021650 | A1 * | 1/2018 | Hoover | A63B 69/22 482/83 |
| 2021/0178239 | A1 * | 6/2021 | Chen | A63B 69/22 |
| 2021/0283482 | A1 * | 9/2021 | Wu | A63B 69/20 |
| 2023/0218966 | A1 * | 7/2023 | Liu | A63B 69/22 482/83 |
| 2024/0009541 | A1 * | 1/2024 | Hadaway | A63B 21/4029 |

FOREIGN PATENT DOCUMENTS

| | | | | |
|---|---|---|---|---|
| WO | WO-2014041371 | A1 * | 3/2014 | A63B 69/004 |

* cited by examiner

*Primary Examiner* — Sundhara M Ganesan
(74) *Attorney, Agent, or Firm* — The Iwashko Law Firm, PLLC; Lev Ivan Gabriel Iwashko

(57) ABSTRACT

An exercise training device, including a main pole, a plurality of training arms disposed on at least a portion of the main pole to move in the first direction or the second direction in response to an application of force thereto, a plurality of collar clamps disposed between each of the plurality of training arms to secure each of the plurality of training arms to the main pole, and a plurality of ball bearings disposed between each of the plurality of training arms to facilitate movement of each of the plurality of training arms around an axis in a perpendicular direction with respect to the main pole.

4 Claims, 1 Drawing Sheet

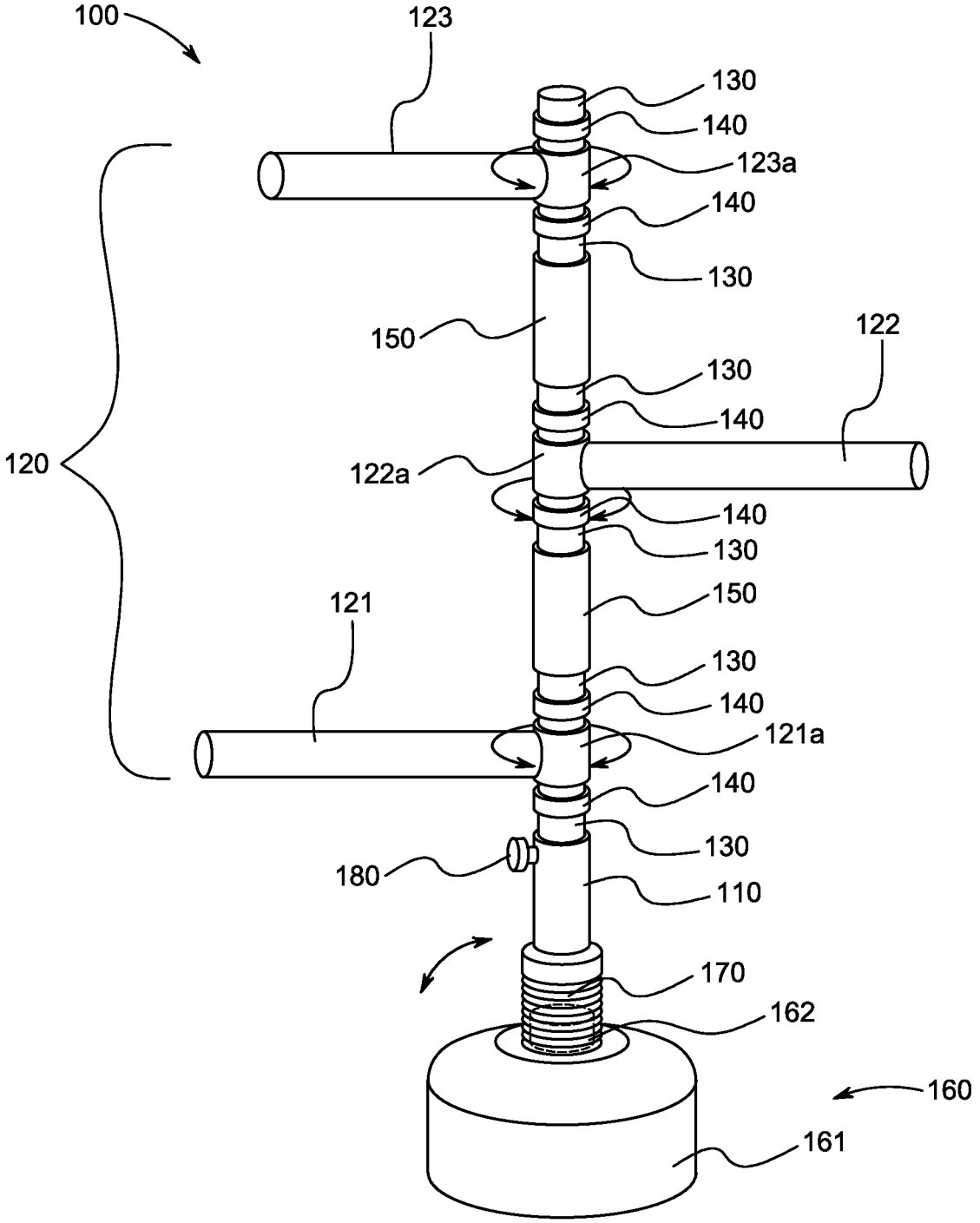
100
123
130
140
123a
140
130
150
122
130
140
120
122a
140
130
150
121
130
140
121a
140
130
180
110
170
162
160
161

EXERCISE TRAINING DEVICE

BACKGROUND

1. Field

The present general inventive concept relates generally to exercise, and particularly, to an exercise training device.

2. Description of the Related Art

Martial arts are a system and ideology of combat used for different purposes, such as self-defense, competition, and/or exercise. Improvement in martial arts requires dedication and persistence in training.

Many martial arts practitioners use a variety of means and/or tools to practice their skills. Moreover, practicing can include another practitioner and/or a training dummy. However, most training dummies are static structures with immovable parts while partners offer more dynamic training.

Therefore, there is a need for an exercise training device that simulates training for martial arts with a live partner.

SUMMARY

The present general inventive concept provides an exercise training device.

Additional features and utilities of the present general inventive concept will be set forth in part in the description which follows and, in part, will be obvious from the description, or may be learned by practice of the general inventive concept.

The foregoing and/or other features and utilities of the present general inventive concept may be achieved by providing an exercise training device, including a main pole, a plurality of training arms disposed on at least a portion of the main pole to move in the first direction or the second direction in response to an application of force thereto, a plurality of collar clamps disposed between each of the plurality of training arms to secure each of the plurality of training arms to the main pole, and a plurality of ball bearings disposed between each of the plurality of training arms to facilitate movement of each of the plurality of training arms around an axis in a perpendicular direction with respect to the main pole.

The plurality of collar clamps may surround each of the plurality of training arms.

The plurality of ball bearings may surround each of the plurality of training arms.

The exercise training device may further include a plurality of connecting poles disposed between each of the plurality of training arms to connect at least one first of the plurality of collar clamps to at least one second of the plurality of collar clamps.

The exercise training device may further include a base removably connected to the main pole to store at least one of sand and water therein to stabilize the main pole on an external surface.

The base may include a container to receive at least one of the sand and water therein, and a cap removably connected to the container to prevent access within the container in a first position and allow access within the container in a second position.

The exercise training device may further include a spring disposed on at least a portion of the container around the cap to move the main body back-and-forth in a springing motion in response to an application of force on at least one of the main body, the plurality of training arms, the plurality of collar clamps, and the plurality of ball bearings.

BRIEF DESCRIPTION OF THE DRAWINGS

These and/or other features and utilities of the present generally inventive concept will become apparent and more readily appreciated from the following description of the embodiments, taken in conjunction with the accompanying drawings of which:

FIG. 1 illustrates a side perspective view of an exercise training device, according to an exemplary embodiment of the present general inventive concept.

DETAILED DESCRIPTION

Various example embodiments (a.k.a., exemplary embodiments) will now be described more fully with reference to the accompanying drawings in which some example embodiments are illustrated. In the figures, the thicknesses of lines, layers and/or regions may be exaggerated for clarity.

Accordingly, while example embodiments are capable of various modifications and alternative forms, embodiments thereof are shown by way of example in the figures and will herein be described in detail. It should be understood, however, that there is no intent to limit example embodiments to the particular forms disclosed, but on the contrary, example embodiments are to cover all modifications, equivalents, and alternatives falling within the scope of the disclosure. Like numbers refer to like/similar elements throughout the detailed description.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent," etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be taken into account in the specific context this definition is given herein.

LIST OF COMPONENTS

Exercise Training Device 100
Main Pole 110
Training Arms 120
First Arm 121
First Connecting Section 121*a*
Second Arm 122
Second Connecting Section 122*a*
Third Arm 123
Third Connecting Section 123*a*
Collar Clamps 130
Ball Bearings 140
Connecting Poles 150
Base 160
Container 161
Cap 162
Spring 170
Knob 180

FIG. 1 illustrates a side perspective view of an exercise training device 100, according to an exemplary embodiment of the present general inventive concept.

The exercise training device 100 may be constructed from at least one of metal, plastic, wood, and rubber, etc., but is not limited thereto. Also, the exercise training device 100 may have foam thereon to absorb impact and prevent injury to a user. The exercise training device 100 may be specially constructed to emit sounds similar to fighting in response to receiving the impact thereon.

The exercise training device 100 may include a main pole 110, a plurality of training arms 120, a plurality of collar clamps 130, a plurality of ball bearings 140, a plurality of connecting poles 150, a base 160, a spring 170, and a knob 180, but is not limited thereto.

Referring to FIG. 1, the main pole 110 is illustrated to have a cylindrical shape. However, the main pole 110 may be rectangular, circular, triangular, pentagonal, hexagonal, heptagonal, octagonal, or any other shape known to one of ordinary skill in the art, but is not limited thereto.

The main pole 110 may be elongate and sturdy. Moreover, the main pole 110 may absorb an impact thereto, such as receiving a strike from a punch and/or a kick by the user.

The plurality of training arms 120 may include a first arm 121, a second arm 122, and a third arm 123, but is not limited thereto.

The first arm 121 may be movably (i.e., rotatably) disposed on at least a portion of the main pole 110. The first arm 121 may move (i.e., rotate) three hundred sixty (360) degrees in a first direction (i.e., clockwise) or a second direction (i.e., counterclockwise) in response to an application of force (e.g., punching, kicking, pushing, pulling) thereto. In other words, the first arm 121 may spin and/or rotate in response to being struck by the user during martial arts training.

The first arm 121 may include a first connecting section 121*a*, but is not limited thereto.

The first connecting section 121*a* may have a pole receiving aperture to receive a pole therethrough.

The second arm 122 may be movably (i.e., rotatably) disposed on at least a portion of the main pole 110. The second arm 122 may move (i.e., rotate) three hundred sixty (360) degrees in the first direction (i.e., clockwise) or the second direction (i.e., counterclockwise) in response to an application of force (e.g., punching, kicking, pushing, pulling) thereto. In other words, the second arm 122 may spin and/or rotate in response to being struck by the user during martial arts training.

The second arm 122 may include a second connecting section 122*a*, but is not limited thereto.

The second connecting section 122*a* may have a pole receiving aperture to receive a pole therethrough.

The third arm 123 may be movably (i.e., rotatably) disposed on at least a portion of the main pole 110. The third arm 123 may move (i.e., rotate) three hundred sixty (360) degrees in the first direction (i.e., clockwise) or the second direction (i.e., counterclockwise) in response to an application of force (e.g., punching, kicking, pushing, pulling) thereto. In other words, the third arm 123 may spin and/or rotate in response to being struck by the user during martial arts training.

The third arm 123 may include a third connecting section 123*a*, but is not limited thereto.

The third connecting section 123*a* may have a pole receiving aperture to receive a pole therethrough.

The first arm 121 may be disposed at a waist area of the user, the second arm 122 may be disposed at a shoulder area of the user, and/or the third arm 123 may be disposed at a head area of the user. The first arm 121, the second arm 122, and/or the third arm 123 may be distanced from each other.

As such, the first arm 121, the second arm 122, and/or the third arm 123 may simulate practice of martial arts with a live opponent. More specifically, striking the first arm 121, the second arm 122, and/or the third arm 123 may cause each to move and attempt to strike the user during spinning. Thus, the user may practice martial arts skills, reflexes, and/or hand-eye coordination.

The plurality of collar clamps 130 may be disposed between the main pole 110 and the first arm 121, between the first arm 121 and the second arm 122, between the second arm 122 and the third arm 123, on an end surrounding the third arm 123. Additionally, each of the plurality of collar clamps 130 may surround (i.e., on each side thereof) the first connecting section 121*a*, the second connecting section 122*a*, and/or the third connecting section 123*a*. Therefore, the first connecting section 121*a*, the second connecting section 122*a*, and/or the third connecting section 123*a* may receive at least one of the plurality of collar clamps 130 therethrough. The plurality of collar clamps 130 may connect and/or secure the first arm 121, the second arm 122, and/or the third arm 123 to the main pole 110.

The plurality of ball bearings 140 may be disposed between the main pole 110 and the first arm 121, between the first arm 121 and the second arm 122, between the second arm 122 and the third arm 123, on the end surrounding the third arm 123. Additionally, each of the plurality of ball bearings 140 may surround (i.e., on each side thereof) the first connecting section 121*a*, the second connecting section 122*a*, and/or the third connecting section 123*a*. Each of the plurality of ball bearings 140 may facilitate movement (i.e., rotation) of the first arm 121, the second arm 122, and/or the third arm 123 around an axis in a perpendicular direction with respect to the main pole 110.

The plurality of connecting poles 150 may be disposed between first arm 121 and the second arm 122, and between the second arm 122 and the third arm 123. Each of the plurality of connecting poles 150 may connect at least one first of the plurality of collar clamps 130 to at least one second of the plurality of collar clamps 130. As such, the plurality of connecting poles 150 may extend a length and/or a height of the main pole 110.

The base 160 may include a container 161 and a cap 162, but is not limited thereto.

The container 161 may be removably disposed on an external surface (e.g., a ground surface, a table, a countertop, etc.) and/or removably connected to at least a portion of the main pole 110. The container 161 may store sand and/or liquid (e.g., water) therein. As such, the container 161 may have a weight to prevent the main pole 110, the plurality of arms 120, the plurality of collar clamps 130, the plurality of ball bearings 140, and/or the plurality of connecting poles 160 from moving away and/or falling over. Accordingly, the container 161 may stabilize the main pole 110, the plurality of arms 120, the plurality of collar clamps 130, the plurality of ball bearings 140, and/or the plurality of connecting poles 160.

The cap 162 may be removably connected (i.e., threadably screwed on) to the container 161. The cap 162 may move (i.e., rotate) from closed on the container 161 in a first position to at least partially opened away from the container 161 in a second position. Conversely, the cap 162 may move (i.e., rotate) from opened away from the container 161 in the second position to closed on the container 161 in the first position. In other words, the cap 162 may prevent access within the container 161 in the first position and allow access within the container 161 in the second position. As such, the container 161 may receive the sand and/or the liquid while the cap 162 is removed.

The spring 170 may be springingly disposed on at least a portion of the container 161 around the cap 162. The spring 170 may be removed to allow access to the cap 162 as necessary. The spring 170 may allow the main pole 110, the plurality of arms 120, the plurality of collar clamps 130, the plurality of ball bearings 140, and/or the plurality of connecting poles 160 to move in response to the application of force thereon. More specifically, the main pole 110, the plurality of arms 120, the plurality of collar clamps 130, the plurality of ball bearings 140, and/or the plurality of connecting poles 160 may bounce back-and-forth in a springing motion in response to the application of force, such as being struck by the user during martial arts practice.

The knob 180 may be movably (i.e., rotatably) disposed on at least a portion of the main pole 110. The knob 180 may prevent removal of at least one of the plurality of collar clamps 130 within the main body 110 in response to moving (i.e., rotating) in a first direction (i.e., clockwise). Conversely, the knob 180 may allow removal of at least one of the plurality of collar clamps 130 from the main body 110 in response to moving (i.e., rotating) in a second direction (i.e., counterclockwise).

Therefore, the exercise training device 100 may simulate training with a live partner by the user. Also, the exercise training device 100 may improve martial arts skills, cardio, mobility, and/or reflexes during practice through movement of the plurality of arms 120.

The present general inventive concept may include an exercise training device 100, including a main pole 110, a plurality of training arms 120 disposed on at least a portion of the main pole 110 to move in the first direction or the second direction in response to an application of force thereto, a plurality of collar clamps 130 disposed between each of the plurality of training arms 120 to secure each of the plurality of training arms 120 to the main pole 110, and a plurality of ball bearings 140 disposed between each of the plurality of training arms 120 to facilitate movement of each of the plurality of training arms 120 around an axis in a perpendicular direction with respect to the main pole 110.

The plurality of collar clamps 130 may surround each of the plurality of training arms 120.

The plurality of ball bearings 140 may surround each of the plurality of training arms 120.

The exercise training device 100 may further include a plurality of connecting poles 150 disposed between each of the plurality of training arms 120 to connect at least one first of the plurality of collar clamps 130 to at least one second of the plurality of collar clamps 130.

The exercise training device 100 may further include a base 160 removably connected to the main pole 110 to store at least one of sand and water therein to stabilize the main pole 110 on an external surface.

The base 160 may include a container 161 to receive at least one of the sand and water therein, and a cap 162 removably connected to the container 161 to prevent access within the container 161 in a first position and allow access within the container 161 in a second position.

The exercise training device 100 may further include a spring 170 disposed on at least a portion of the container 161 around the cap 162 to move the main body 110 back-and-forth in a springing motion in response to an application of force on at least one of the main body 110, the plurality of training arms 120, the plurality of collar clamps 130, and the plurality of ball bearings 140.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

The invention claimed is:

1. An exercise training device, comprising:

a main pole;

a plurality of training arms disposed on at least a portion of the main pole to move in the first direction or the second direction in response to an application of force thereto;

a plurality of collar clamps disposed between each of the plurality of training arms to secure each of the plurality of training arms to the main pole;

a plurality of ball bearings disposed between each of the plurality of training arms to facilitate movement of each of the plurality of training arms around an axis in a perpendicular direction with respect to the main pole; and a base disposed at a bottom-most portion of the exercise training device and configured to be removably connected to the main pole to store at least one of sand and water therein to stabilize the main pole on an external surface, the base comprising:

a container to receive at least one of the sand and water therein, a cap removably connected to the container to prevent access within the container in a first position and allow access within the container in a second position, and a spring to directly contact a top portion of the container and to be disposed around the cap to move the main body back-and-forth in a springing motion in response to an application of force on at least one of the main body, the plurality of training arms, the plurality of collar clamps, and the plurality of ball bearings.

2. The exercise training device of claim 1, wherein the plurality of collar clamps surrounds each of the plurality of training arms.

3. The exercise training device of claim 1, wherein the plurality of ball bearings surrounds each of the plurality of training arms.

4. The exercise training device of claim 1, further comprising:

a plurality of connecting poles disposed between each of the plurality of training arms to connect at least one first of the plurality of collar clamps to at least one second of the plurality of collar clamps.

* * * * *